US007343869B2

(12) United States Patent
Futaki

(10) Patent No.: US 7,343,869 B2
(45) Date of Patent: Mar. 18, 2008

(54) SEAT STRUCTURE FOR SMALL PLANING CRAFT

(75) Inventor: Yoshiki Futaki, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/207,332

(22) Filed: Aug. 19, 2005

(65) Prior Publication Data

US 2006/0037523 A1 Feb. 23, 2006

(30) Foreign Application Priority Data

Aug. 19, 2004 (JP) ..... 2004-239323

(51) Int. Cl.
*B63B 17/00* (2006.01)

(52) U.S. Cl. ..... 114/363; 114/55.56; 114/55.57

(58) Field of Classification Search ..... 114/363, 114/55.56, 55.57

See application file for complete search history.

(56) References Cited

U.S. PATENT DOCUMENTS

| | | | | |
|---|---|---|---|---|
| 3,095,232 | A * | 6/1963 | Stevens | 296/65.09 |
| 3,998,176 | A | 12/1976 | Stout et al. | |
| 4,733,627 | A | 3/1988 | Nishida | |
| 4,941,421 | A | 7/1990 | Anderson | |
| 4,989,532 | A | 2/1991 | Kishi et al. | |
| 5,056,450 | A | 10/1991 | Mardikian | |
| 5,282,437 | A * | 2/1994 | Avillez de Basto | 114/345 |
| 5,353,734 | A | 10/1994 | Tani | |
| 2005/0016440 | A1 * | 1/2005 | Simard et al. | 114/363 |

FOREIGN PATENT DOCUMENTS

| | | |
|---|---|---|
| JP | 58-129287 | 9/1983 |
| JP | 2-169390 | 6/1990 |
| JP | 5-238476 | 9/1993 |
| JP | 05-201276 A | 10/1993 |
| JP | 10-076990 | 3/1998 |
| JP | 2757999 B | 3/1998 |

OTHER PUBLICATIONS

Product Advertisement of Seadoo 3D Premium. Website: http://www.seadoo.com/en-US/Watercrafts/2005/Sport/3D.Premium/Introduction.htm.

* cited by examiner

*Primary Examiner*—Sherman Basinger
(74) *Attorney, Agent, or Firm*—Knobbe, Martens, Olson & Bear, LLP

(57) ABSTRACT

A storage space can be defined above an engine hatch of a hull. A rear end portion of the hatch cover can have an opening into which a seat can be retracted into the storage space. A rear end portion of the seat can define part of the hatch cover when the seat is retracted within the storage space. A rail section can be disposed within the storage space. The seat can be movable between the inside and outside of the storage space by moving along the rail section in a fore to aft direction. Also, a support unit can engage with a bottom end of a guide groove to support the seat when the seat extends from the hatch cover.

14 Claims, 16 Drawing Sheets

SEAT STRUCTURE FOR SMALL PLANING CRAFT

PRIORITY INFORMATION

This application claims priority to Japanese patent application Serial No. 2004-239323, filed on Aug. 19, 2004, the entire contents of which is hereby expressly incorporated by reference.

BACKGROUND OF THE INVENTIONS

1. Field of the Inventions

The present inventions relate to a seat structure for a watercraft, and more particularly to retractable seats for small watercraft.

2. Description of the Related Art

Small planing watercraft, such as those commonly referred to as "sit-down type personal watercraft," can be operated with the operator sitting on a seat that is fixed to a top portion of the hull. For example, Japanese Patent Publication JP-A-Hei05-201276 discloses such a design.

Other personal watercraft, such as the "stand-up-type," have no seat, and the rider operates the handlebars and throttle lever while standing on a floor section disposed in a rear portion of the hull. For example, Japanese Patent Publication JP-B-2757999 discloses such a watercraft.

Stand-up watercraft typically have a steering pole, the forward end of which is hingedly coupled with a front portion of the hull. This arrangement allows the pole to pivot in a vertical direction, i.e., about a generally horizontal pivot axis. The height of the steering handlebars disposed at a rear end of the steering pole can thus be adjusted by the, operator.

SUMMARY OF THE INVENTIONS

An aspect of at least one of the embodiments disclosed herein includes the realization that a seat of watercraft can be connected to the watercraft in a manner that allows the watercraft to be quickly converted from a stand-up type watercraft to a sit-down type watercraft without having to remove the seat from the watercraft. For example, but without limitation, there are spaces within small watercraft that can be used to store a seat in a manner that allows the seat to be pulled out and pushed into such a space, depending on the desires of the operator.

Thus, in accordance with an embodiment, a seat structure is provided for a small planing watercraft which comprises a deck forming an upper hull, a forward portion of the deck having a front deck section, a rear portion of the deck having a generally horizontally extending floor section, steering handlebars generally extending above a center portion of the deck in a fore to aft direction of the hull, and a seat for a rider disposed in the rear of the front deck section. The seat structure can comprise a rear portion of the front deck, the rear portion having an engine hatch, and a hatch cover disposed for selectively closing and opening the engine hatch. The rear portion can define a storage space above the engine hatch, wherein the seat is configured to retract into the storage space.

In accordance with another embodiment, a watercraft comprises a hull. A propulsion system is supported by the hull and is configured to generate thrust for propelling the hull. An operator's area is defined by the hull and is configured to allow an operator to operate the watercraft from the operator's position. The watercraft also includes a storage compartment, and means for allowing the seat to be moved between a retracted position inside the storage compartment and a sitting position in which an operator can sit on the seat and operate the watercraft.

Small planing crafts belonging to the former group of the conventional ones can reduce the rider's fatigue caused from the steerage of the craft. However, the seat rather disturbs the rider while the rider actively steers the hull, i.e., while the rider steers the hull by shifting the center of gravity of the entire weight of his or her own. The latter type small planing crafts can make it possible for the rider to actively steer the craft using the whole area of the floor and the entire weight of his or her own. The rider, however, needs to continuously keep the standing position, and is likely to exhaust his -or her stamina in comparison with the situation in which the rider takes the sitting position on the seat.

DETAILED DESCRIPTION OF THE PREFERRED EMBODIMENTS

Figure 1:
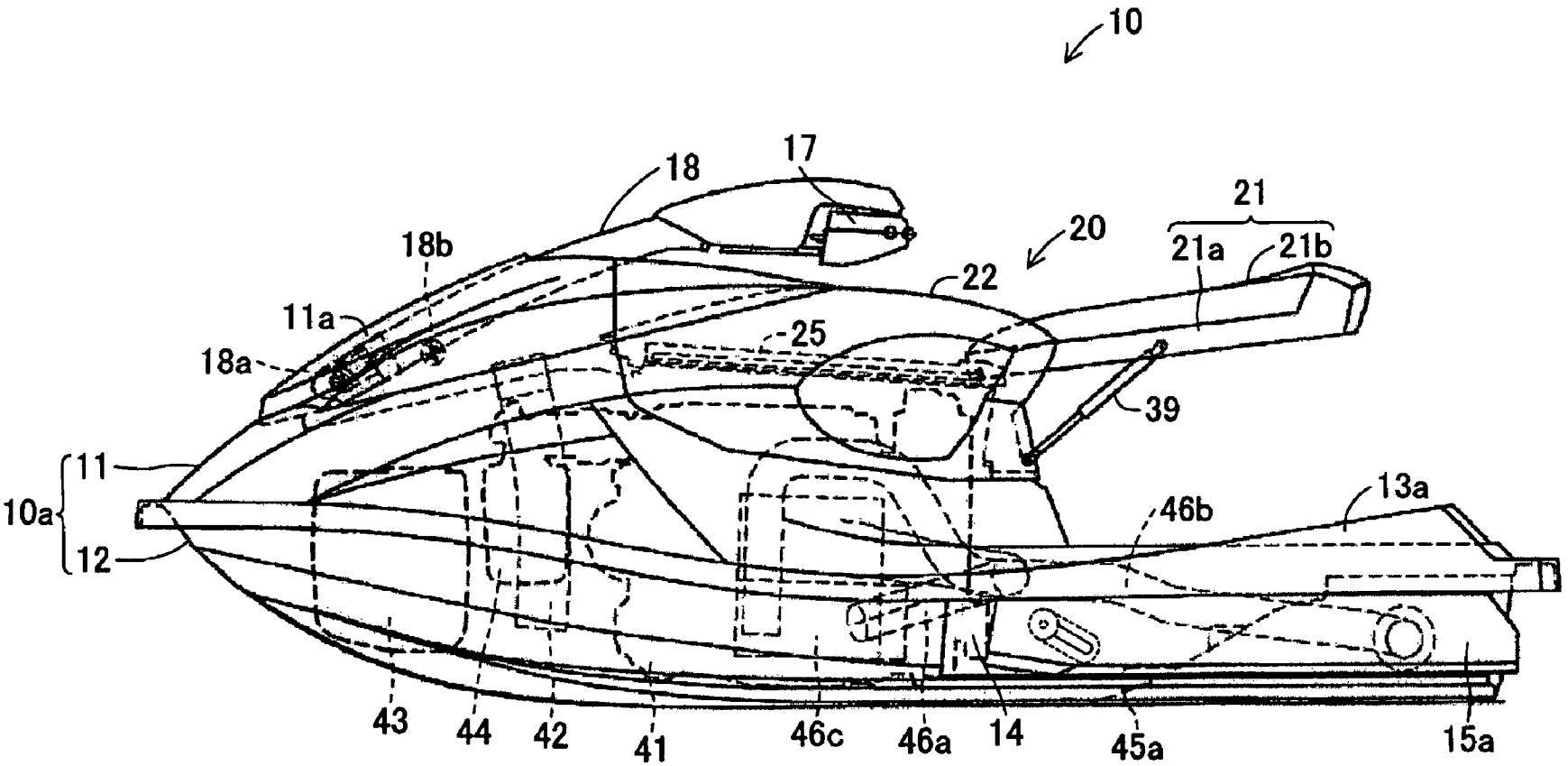
FIG. 1 is a side elevational view of a small planing watercraft with a seat structure configured in accordance with an embodiment, with certain internal components illustrated in phantom.

FIG. 1 illustrates a small planning type watercraft 10 having a seat in accordance with several embodiments. The present seat arrangement is disclosed in the context of a personal watercraft because it has particular utility in this context. However, the seat arrangement can be used in other contexts, such as, for example, but without limitation, other types of watercraft and other vehicles including land vehicles.

Figure 2:
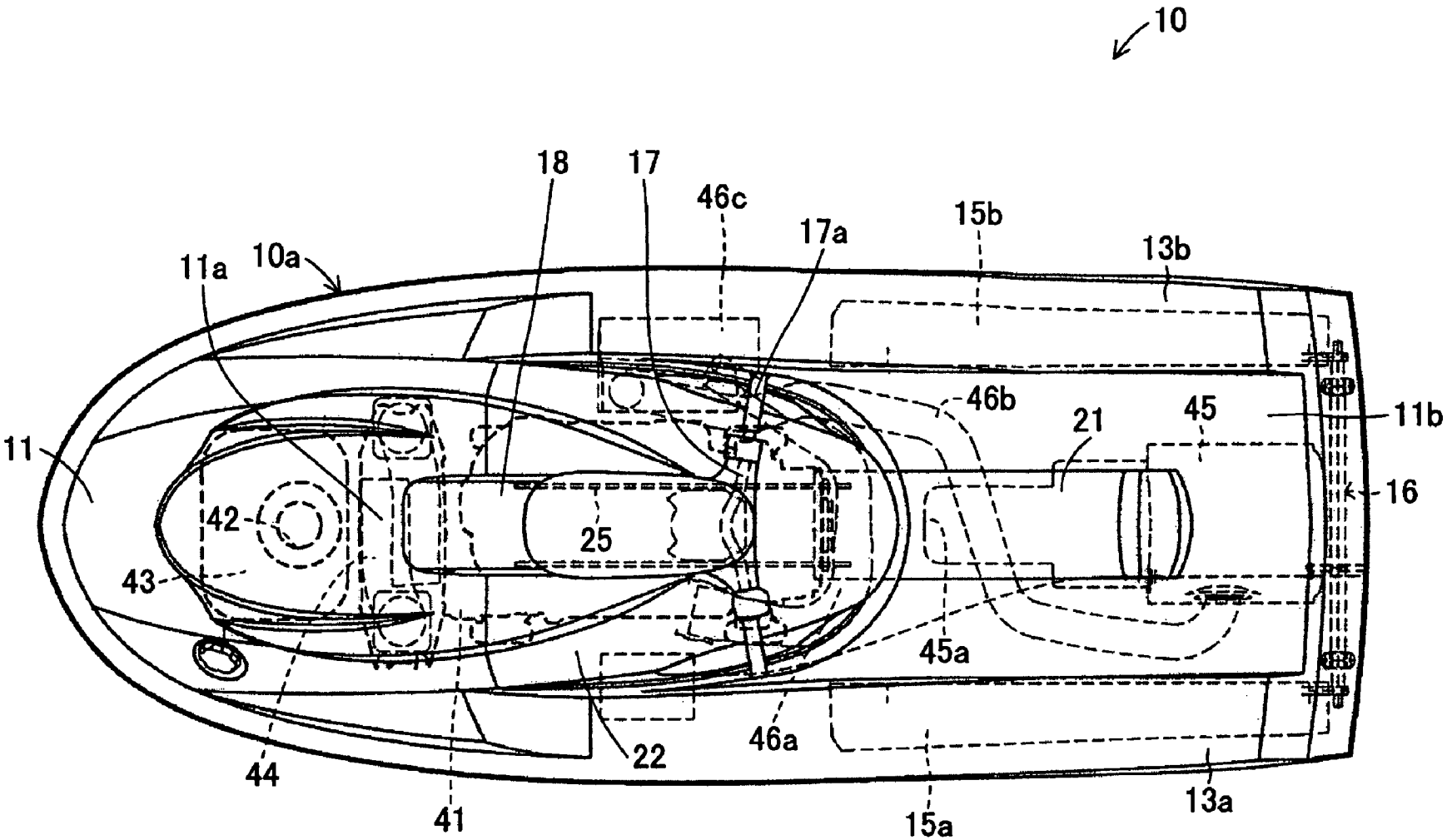
FIG. 2 is a top plan view of the small planing watercraft of FIG. 1.

FIGS. 1 and 2 show a small planing watercraft 10 having a seat structure 20 configured in accordance with an embodiment. A hull 10*a* of this small planing watercraft 10 comprises a deck 11 that forms an upper portion of the hull 10*a* and a lower hull 12.

A forward portion of the deck 11 is formed with a front deck section 11*a* that rises upwardly. A rear portion of the deck 11 has a recessed floor section 11*b* on which the rider can stand. Each of right and left ends of the floor section 11*b* has a side wall 13*b*, 13*a*, respectively.

A lower outer side (lower hull 12) of each side wall 13*a*, 13*b* can have an attachment aid recess 14 (the attachment aid recess for the side wall 13*b* is not shown). A supplemental hull component 15*a*, 15*b* can be attached to the respective attachment aid recesses 14.

Each supplemental hull component 15*a*, 15*b* can be placed so that its position is adjustable in a vertical direction by a lifting mechanism 16 that can be formed with a rotationally driving device or the like. Each supplemental hull component 15*a*, 15*b* can be configured to define a portion of a planing surface. For example, the supplemental hull component 15*a*, 15*b* can be sufficiently wide to widen the planning surface of the hull 12 by a chine width. The buoyancy of the small planing watercraft 10 thus can be increased, and the stability thereof can be improved. The chine width becomes smaller when the respective supplemental hull components 15*a*, 15*b* are positioned higher. Thus, the small planing watercraft 10 can be provided with a larger bank angle during turning.

Steering handlebars 17 can have handling grips 17*a* and can be disposed so as to extend above a generally center portion of the hull 10*a* in the fore to aft direction thereof. A seat 21 can be disposed in the rear of the steering handlebars 17. The steering handlebars 17 can be connected to the hull 10*a* through a connecting pole 18 that is attached thereto for pivotal movement in the vertical direction about an axis of a support shaft 18*a*. Also, the steering handlebars 17 can be coupled with a rear end of the connecting pole 18 for pivotal movement in the right or left direction about an axis at the rear end of the connecting pole 18. The steering handlebars 17 and the connecting pole 18 together form a steering pole.

Figure 3:
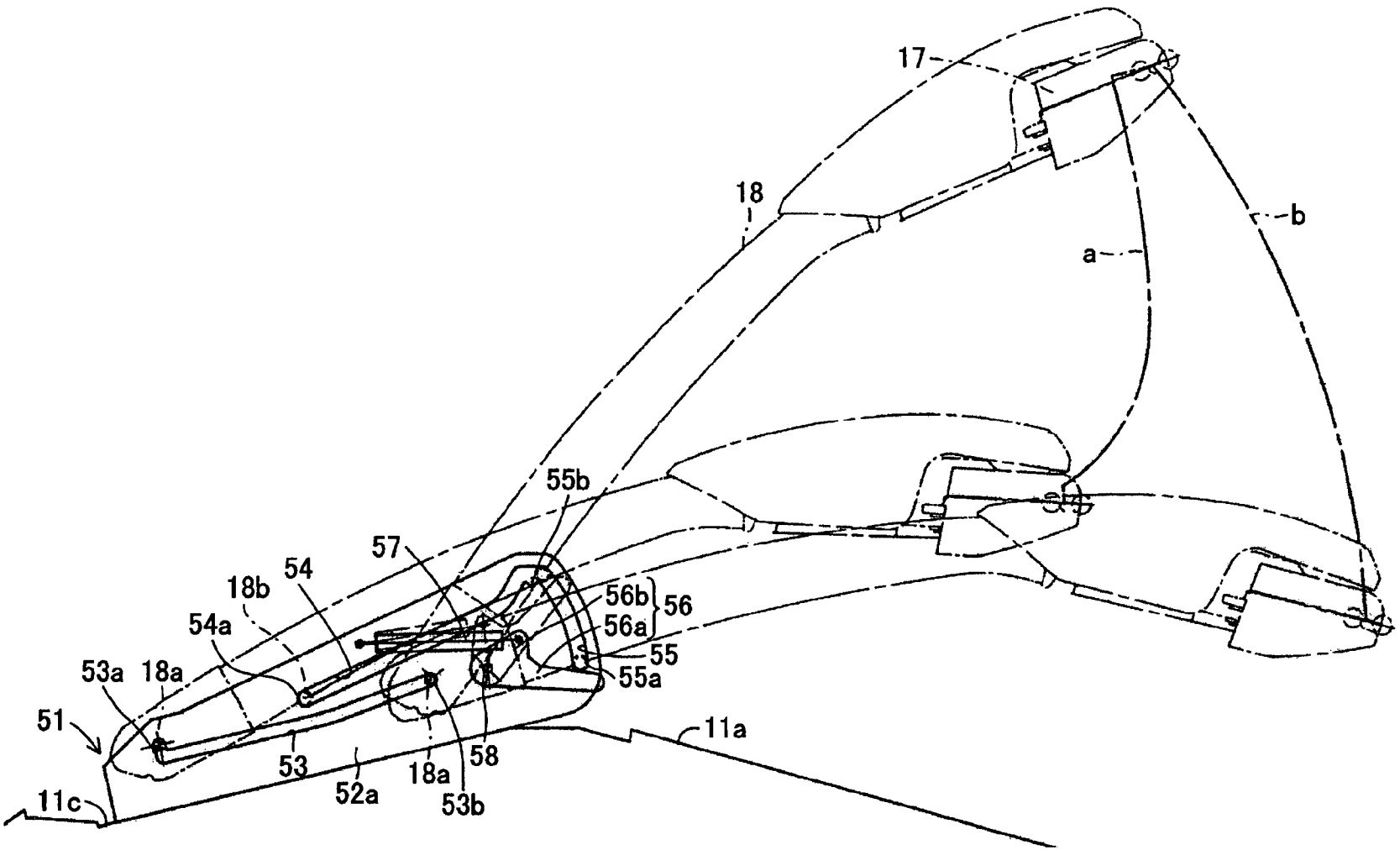
FIG. 3 is an enlarged side elevational view of the handlebars of the watercraft of FIG. 1, showing different optional positions between which the handlebars can be moved.
Figure 4:
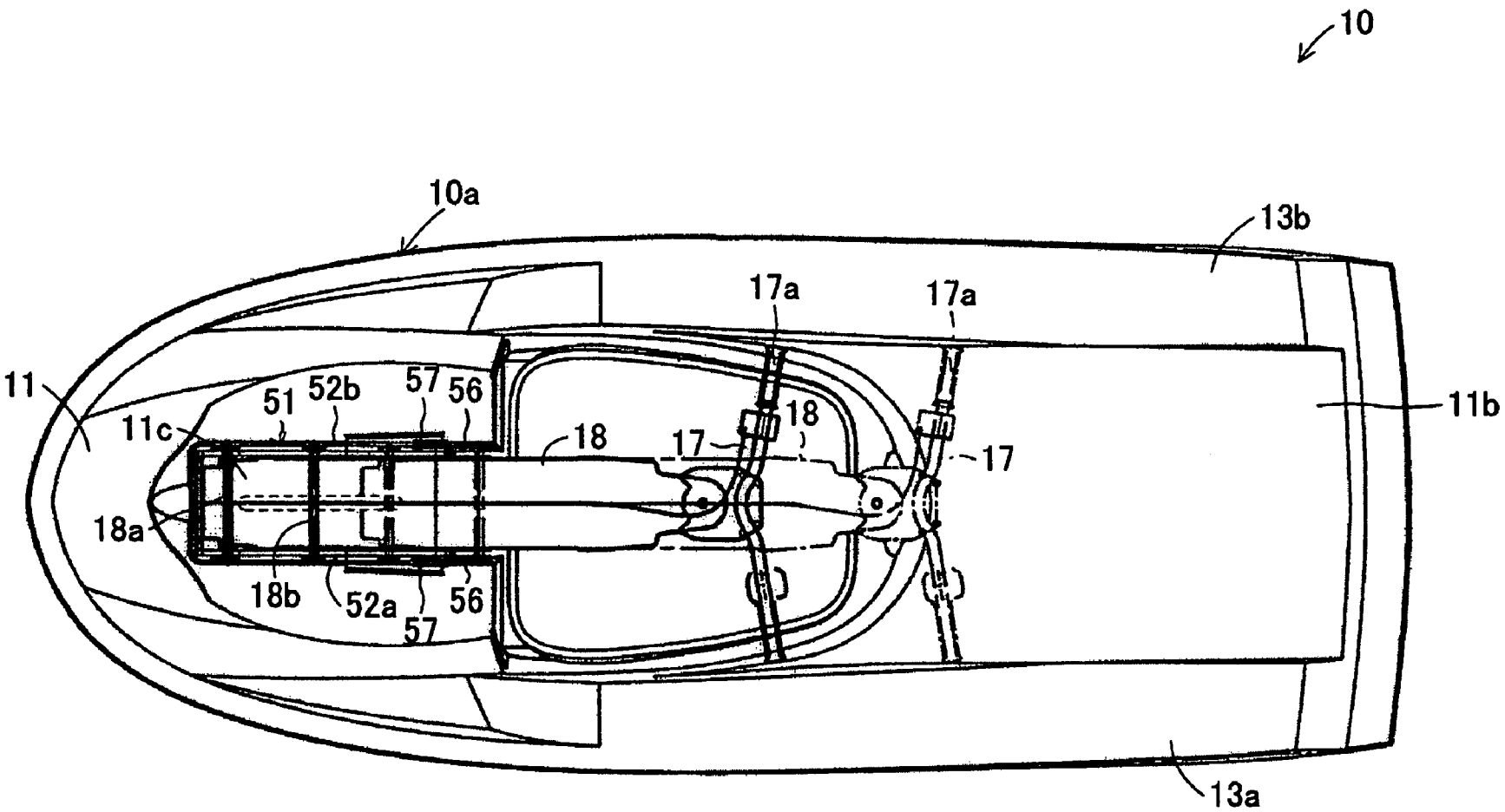
FIG. 4 is a top plan view of the watercraft of FIG. 1 showing the handlebars in the maximum forward and rearward optional positions.

The connecting pole 18 can be attached to a top surface of the front deck section 11*a* in a manner shown in FIGS. 3 and 4. That is, the top surface of the front deck section 11*a* can have a storage support section 51 that can be configured to receive a front end portion of the connecting pole 18 under a reciprocally movable condition and also support it.

The storage support section 51 can have a box-like concave configuration with its rear end being open. An outer surface of the front deck section 11*a* can form a top surface of the storage support section 51, and a base portion 11*c* of the front deck section 11*a* can form a bottom surface of the section 51.

Plate-like brackets 52*a*, 52*b* can be used to form both side surfaces of the section 51. Each bracket 52*a*, 52*b* can have a slide groove 53 configured for supporting a shaft and a slide groove 54 configured for supporting a guide shaft (both slide grooves of each bracket 52*a*, 52*b* are not shown).

Each support shaft slide groove 53 can be a slot that extends along a slope of the base portion 11*c* of the front deck section 11*a*. The grooves 53 can slope slightly upwardly toward its rear end from its front end. A slope angle of a rear portion of the slot is preferably larger than a slope angle of a front portion thereof.

An upper forward edge of the support shaft slide groove 53 can have a support shaft engagement recess 53*a*. The support shaft engagement recess 53*a* can extend upwardly with a width that is the same as that of the support shaft slide groove 53. Preferably, a configuration of a top end of the recess 53*a* is generally a semi-circle in a side view.

Each guide shaft slide groove 54 can be a slot positioned above and in the rear of the support shaft slide groove 53 of each bracket 52*a*, 52*b*. Each guide shaft slide groove 54 can extend upwardly and rearwardly from a location generally above a center portion of the support shaft slide groove 53, and its rear portion can be formed with an arcuate groove section 55. A slope angle of a front portion of the guide shaft slide groove 54 is preferably larger than the slope angle of the rear portion of the support shaft slide groove 53. A rear end of the front end portion of the guide shaft slide groove 54 curves upwardly and communicates with the arcuate groove section 55 in the rear of the curve.

The arcuate groove section 55 can be arcuately formed with its center of curvature positioned at a rear end 53*b* of the support shaft slide groove 53. Preferably, the height of a bottom end 55*a* of the arcuate groove section 55 is generally equal to the height of the rear end 53*b* of the support shaft slide groove 53.

The arcuate groove section 55 can have a guide shaft engagement recess 55*b* at a lower edge of its portion where the rear end of the front end portion of the arcuate guide shaft slide groove 54 intersects a top end of the arcuate groove section 55. Preferably, a configuration of the guide shaft engagement recess 55*b* is generally a semi-circular in a side view, for example.

A lever 56 and a spring 57 can be attached to an outer surface of each bracket 52*a*, 52*b*. Each lever 56 can have a hook shape with a long leg 56*a* and a short leg 56*b*.

With continued reference to FIG. 3, a pivot shaft 58 can be used to support a base end of the lever 56 for pivotal movement. The spring 57 can extend between a top end of the short leg 56*b* and a generally center portion of a top outer surface of each bracket 52*a*, 52*b* to bias the long leg 56*a* of the associated lever 56 upwardly. The long leg 56*a* extends to a rear portion of the arcuate groove section 55 so that a rear end (top end) of the spring reaches the position of the guide shaft engagement recess 55*b* when the spring 57 shrinks toward its minimum length.

The front end of the connecting pole 18 can have an aperture extending transversely. The support shaft 18*a* can extend through the aperture. Both ends of the support shaft 18*a* can protrude beyond respective side surfaces of the connecting pole 18 and enter the respective support shaft slide grooves 53.

The guide shaft 18*b* can be affixed to a lower portion of the connecting pole 18 located in the rear of the support shaft 18*a*. Both ends of the guide shaft 18*b* can extend into the respective guide shaft slide grooves 54.

Preferably, the guide shaft 18*b* is positioned at a front end 54*a* of the guide shaft slide groove 54 when the support shaft 18*a* is positioned at a front end of the support shaft slide groove 53. The guide shaft 18*b* can be positioned at the arcuate groove section 55 when the support shaft 18*a* is positioned at a rear end 53*b*. The support shaft 18*a*, the support shaft engagement recess 53*a*, the guide shaft 18*b* and the guide shaft engagement recess 55*b* together can form a movement preventing mechanism.

Figure 5:
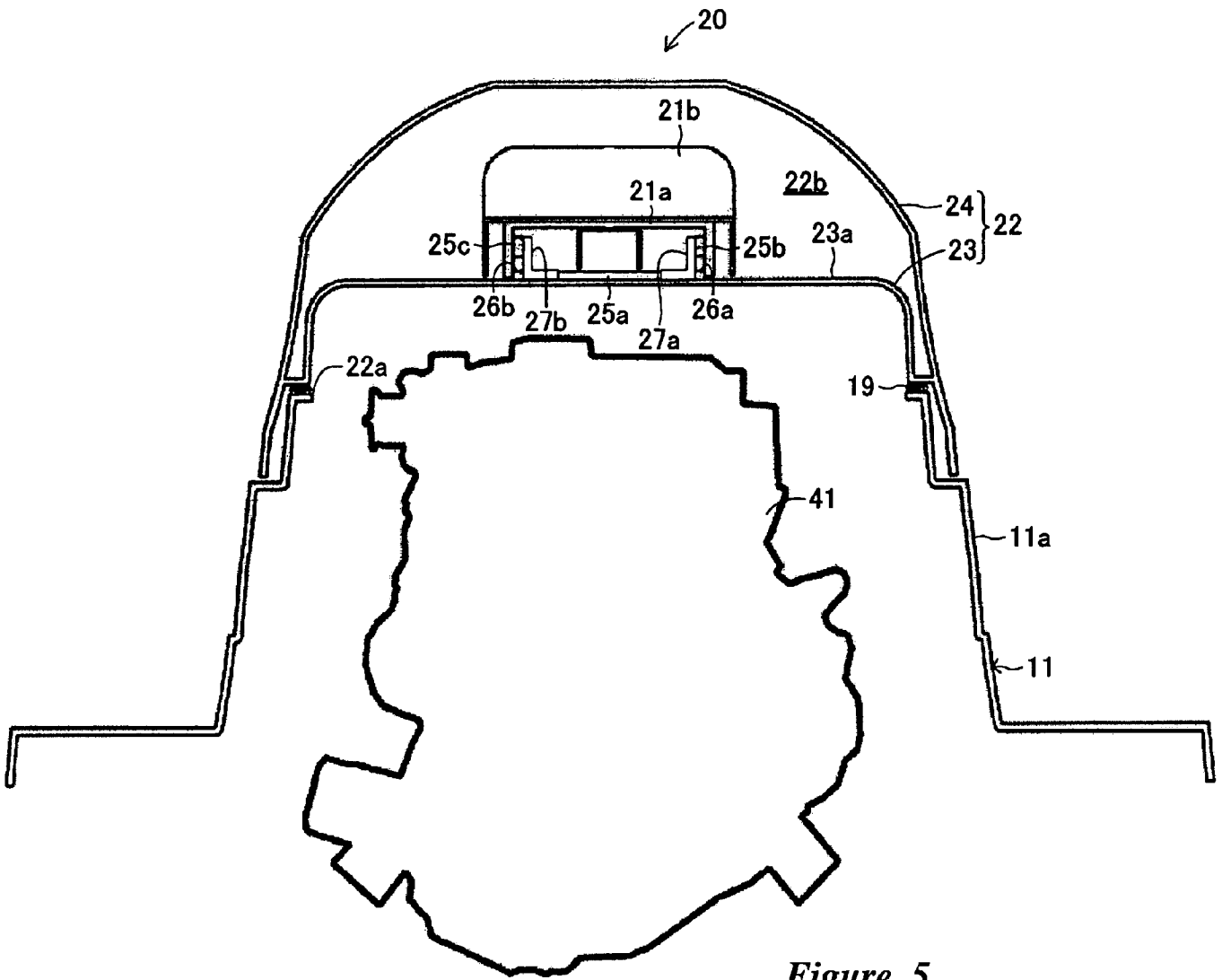
FIG. 5 is a partial schematic cross-sectional view of a portion of the small planing watercraft of FIG. 1, illustrating a portion of the seat structure thereof.
Figure 6:
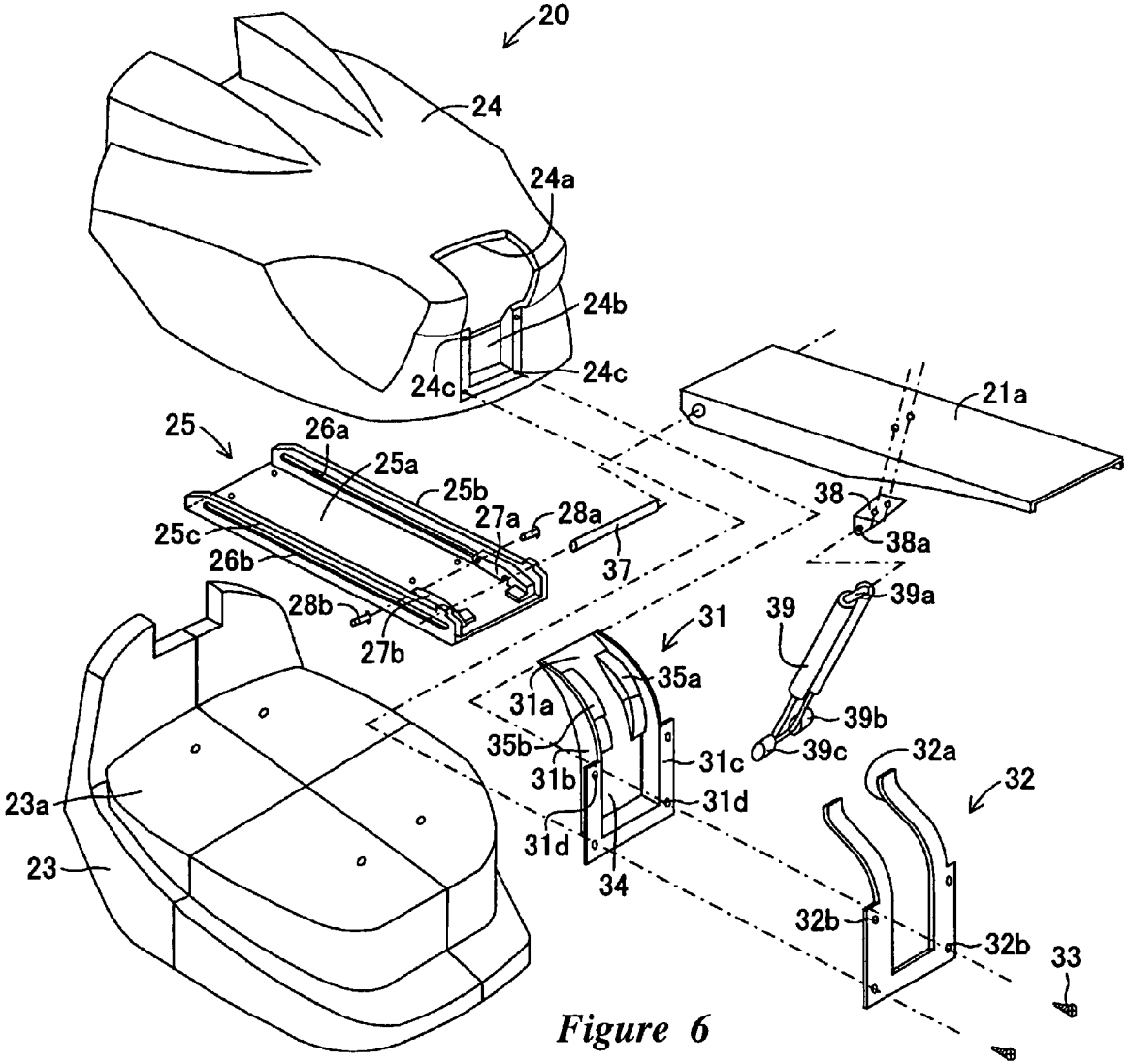
FIG. 6 is an exploded view of the seat structure of the watercraft.

With reference to FIGS. 1, 5, and 6, the seat 21 can be disposed in the rear of the hatch cover 22 that is formed in an upper rear portion of the front deck 11*a*. The seat 21 can also be movable relative to the hatch cover 22 to extend from or be retracted to the hatch cover 22.

For example, as shown in FIG. 5, the upper rear portion of the front deck 11*a* can define an engine hatch 22*a*. The hatch cover 22 can be disposed for selectively closing and opening the engine hatch 22*a*. A seal 19 can be interposed between the body of the front deck section 11*a* and the hatch cover 22 to for a substantially water-tight seal therebetween. The seat structure 20 can comprise the seat 21, the hatch cover 22, the engine hatch 22*a* and as well as other components. FIG. 6 shows an exploded view of the seat structure 20.

With continued reference to FIG. 6, the hatch cover 22 can be an assembly of an inner cover 23 and an outer cover 24. The inner cover 23 can be positioned within the front deck section 11*a*, and the outer cover 24 can be used to form an outer surface of the front deck section 11*a*.

The inner and outer covers 23, 24 can form a storage space 22*b* therebetween. That is, the inner cover 23 can be a cover member having a platform 23*a* which top surface can be generally flat, although the top surface 23*a* can have other shapes and/or contours. The outer cover 24 can be a curved coyer member extending over the inner cover 23 to define the storage space 22*b* above the top surface of the platform 23*a* of the inner cover 23.

The outer cover 24 can have an opening 24*a* extending between a top rear end portion and a lower rear portion. The outer cover 24 can also have a recessed portion 24*b* extending below the opening 24*a* in a rear surface of the outer cover 24 for receiving a guide assembly, which is described below in greater detail.

The recessed portion 24*b* can have four peripheral corners, each of which, in some embodiments, has a screw hole 24*c*. The four screw holes 24*c* can be spaced apart from each other. A base member 25 can be affixed to the top surface of the platform 23*a* of the inner cover 23 by fastening screws (not shown) to extend in the fore to aft direction.

The base member 25 can have a rectangular bottom surface section 25*a* which is elongated and can extend in the fore to aft direction. The base member 25 can also have a pair of side edge portions which extend along respective side edges of the bottom surface section 25*a* in the longitudinal direction.

Each side edge portion can have a rail section 25*b*, 25*c* that has a relatively low side surface. Each rail section 25*b*, 25*c* can have a slide slot 26*a*, 26*b* that can form a slide recess. Each slide slot 26*a*, 26*b* can transversely penetrate the respective rail section 25*b*, 25*c* and can extend generally in the longitudinal direction.

Engagement arm sections 27*a*, 27*b* can extend along respective inner surfaces of the rail sections 25*b*, 25*c* that are opposite each other. Each engagement arm section 27*a*, 27*b* can be affixed to the respective rail section 25*b*, 25*c* by a support shaft 28*a*, 28*b* at an upper location in its rear portion (at a position higher than the slide slot 26*a*, 26*b*) for pivotal movement in the vertical direction.

Figure 7:
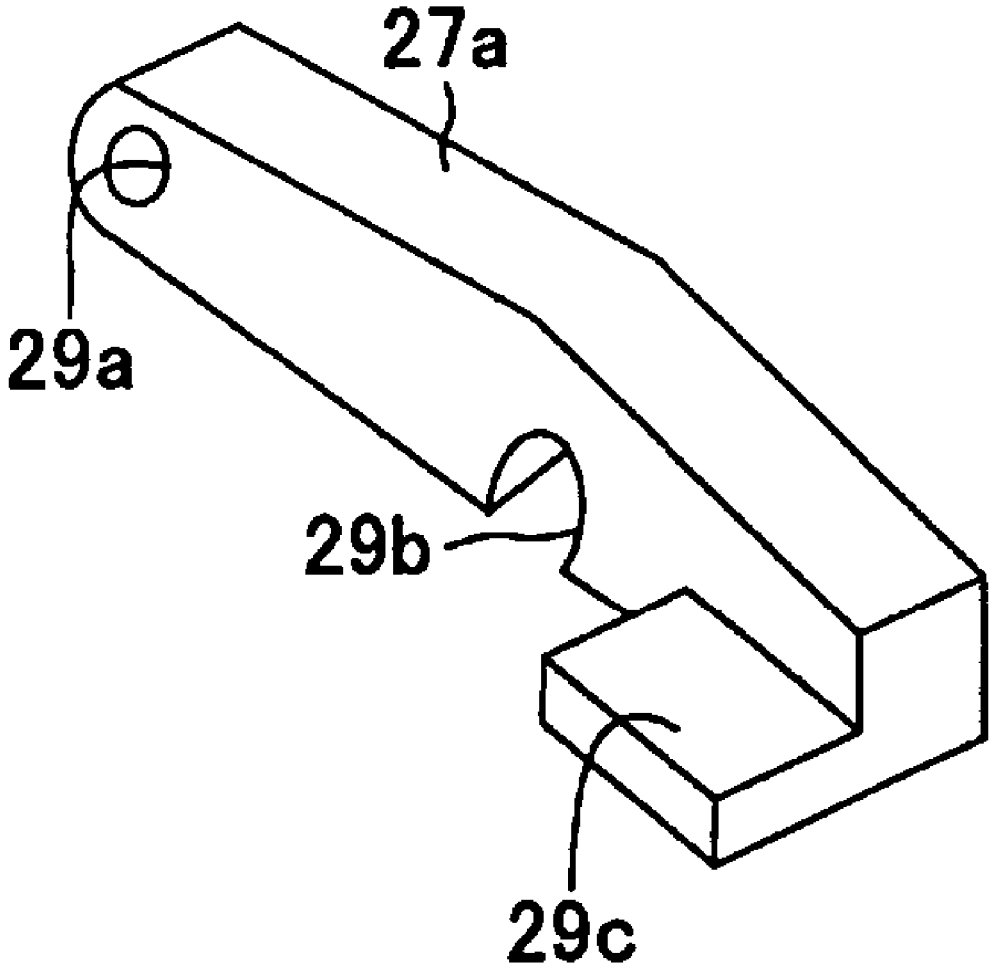
FIG. 7 is an enlarged perspective view of an engagement arm section of the seat structure of FIG. 6.

As shown in FIG. 7, the engagement arm section 27*a* can be formed with a member that extends in the fore to aft direction, and has a shaft hole 29*a* through which the support shaft 28*a* extends. The engagement arm section 27*a* can also have an engagement recess 29*b* formed in a bottom surface and at a slightly rear position than a center portion of the arm section 27*a*.

A raisable portion 29*c*, which can have a rectangular parallelepiped shape, can extend generally horizontally inwardly from a bottom side of a rear end of the engagement arm section 27*a*. The engagement arm section 27*b* can have bilateral symmetry with the engagement arm section 27*a*, and can be affixed to the rail section 25*c* by the support shaft 28*b* for opposing to the engagement arm section 27*a*. However, other configurations can also be used.

A rear end portion of the base member 25 can be coupled with a guide groove forming member 31, which can be a component of the guide assembly. The guide groove forming member 31 can comprise a guide surface section 31*a*, a wall section 31*b* and a fixed piece section 31*c*.

The guide groove forming member 31 can be affixed to a rear end portion of the outer cover 24 with the fixed piece section 31*c* fixed to the recessed portion 24*b*. The guide surface section 31*a* can have an upper portion coupled with a rear end of the bottom surface section 25*a* of the base member 25. The upper portion can extend rearward and gradually curve from the bottom surface section 25*a* of the base member 25, downwardly. The guide surface section 31*a* can also have a lower portion extending generally vertically from the upper portion. That is, the guide surface section 31*a* can be formed with a curved plate-like body.

The wall section 31*b* can extend rearwardly (in the direction normal to the guide surface section 31*a*) along respective side edges and a bottom edge of the guide surface section 31*a*. Lower part of the wall portion 31 can have a fixed width, while the upper part thereof can be tapered upwardly. The fixed piece section 31*c* can be a flange that extends outwardly (transversely and downwardly) from the side edges and the bottom edge of the wall section 31*b*. Four corners of the fixed piece section 31*c* individually can have screw holes 31*d*. The four screw holes 31*d* can be are spaced apart from each other.

A guide opening forming member 32, which can be another component of the guide assembly, can be placed on a rear surface of the guide groove forming member section 31 and can be affixed to the fixed piece section 31*c* of the guide groove forming member 31. The guide opening forming member 32 can be a plate that has a configuration generally similar to the entire configuration of the rear surface of the guide groove forming member 32 except for a guide opening 32*a*, although other configurations can also be used.

The guide opening 32*a* can be a relatively large slit that can be defined in a center area of the plate and is open upward. A portion of the guide opening forming member 32 corresponding to the fixed piece of the guide groove forming member 31 can have four screw holes 32*b* spaced apart from each other. Four fastening screws 33 (only two of which are shown) can be inserted into the respective screw holes 32*b*, 31*d* and are screwed onto the screw holes 24*c*. Thus, the guide groove forming member section 31 and the guide opening forming member 32 are affixed to the outer cover 24. The guide groove forming member section 31 and the guide opening forming member 32 together can define a groove or space that forms a guide groove 34.

Figure 8:
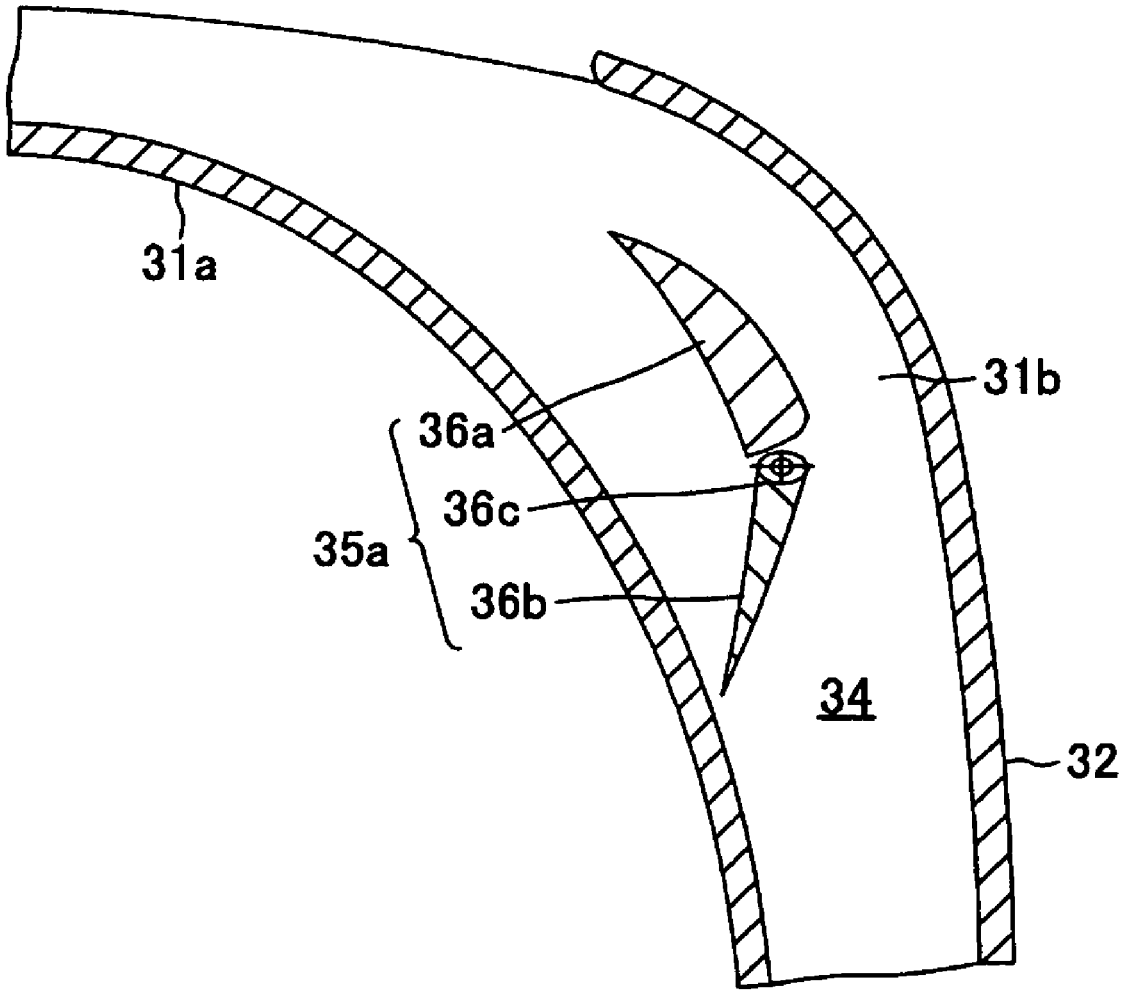
FIG. 8 is an enlarged cross-sectional view of a guide piece unit of the seat assembly, showing an attached state of the guide piece unit.

Guide piece units 35*a*, 35*b* can be attached to the guide groove forming member section 31 at both right and left sides in an upper area of the guide groove 34. As shown in FIG. 8, the guide piece unit 35*a* can include a fixed piece 36*a*, a swingable piece 36*b*, and a support shaft 36*c*.

The fixed piece 36*a* can be fixedly formed on an inner surface of the wall section 31*b* to curve along the upper area of the guide groove 34. The fixed piece 36*a* can be formed with a member that can be tapered upwardly.

The swingable piece 36*b* can be affixed to the support shaft 36*c* for pivotal movement and can be formed with a member tapered downwardly. The support shaft 36*c* can be affixed to the inner surface of the wall section 31*b*.

The swingable arm 36*b* can extend downwardly from the support shaft 36*c* such that a bottom end thereof is disposed in the lower-most position under a normal condition. Also, under the normal condition, the bottom end can be spaced apart narrowly from the guide surface section 31*a* and broadly from the guide opening member 32.

The seat 21 can have a movable section 21*a* that can be formed with an elongated plate that can extend in the fore to aft direction. A cushion 21*b* can be affixed to a top surface of the movable section 21*a*.

A rear end surface of the seat 21 can be configured to fit in the opening 24*a*. In some embodiments, the rear end surface of the seat 21 can be configured to fit in the opening 24*a* tightly, e.g., without leaving any spaces. Thus, a rear end surface of the hatch cover 22 can appear to have no substantial irregularities when the seat 21 is retracted within the hatch cover 22.

Side walls can extend downwardly from both edges of the movable section 21*a* and in the longitudinal direction. A slide pin 37 can extend transversely between respective forward end portions of the side walls. Each end of the slide pin 37 can extend beyond the side wall to engage the respective slide slot 26*a*, 26*b* of the rail section 25*b*, 25*c* so as to be movable in the fore to aft direction along the associated slide slot 26*a*, 26*b*.

Further, when the slide pin 37 moves to the rear portions of the slide slots 26*a*, 26*b*, each end of the slide pin 37 raises the rear end portion of the respective engagement arm section 27*a*, 27*b* and engages with the respective engagement recess 29*b*. Thus, the seat 21 can be prevented from coming off from the base member 25. Also, under such circumstances, the seat 21 can be pivotable in the vertical direction about an axis of the slide pin 37.

With continued reference to FIG. 6, a connecting member 38 can be affixed to a bottom surface of the movable section 21*a* generally at a center portion in the fore to aft direction. The connecting member 38 can have a shaft hole 38*a* extending generally transversely.

A support unit 39 can be coupled with the connecting member 38 such that a pivot shaft 39*a* of the support unit 39 extends through the shaft hole 38*a*. The support unit 39 can comprise any type of damper, each length of which can be adjustable. In some embodiments, the dampers can be gas dampers, hydraulic dampers, struts, or any other type of dampening device.

Thus, the entire length of the support unit 39 can be changeable. In addition, the support unit 39 can absorb shocks with the dampers. The support unit 39 can have a pair of rods extending in a lower portion of the unit 39. Each bottom end of the rod can have a projection 39*b*, 39*c* extending outwardly. Each projection 39*b*, 39*c* can have a columnar roller shape.

Figure 9:
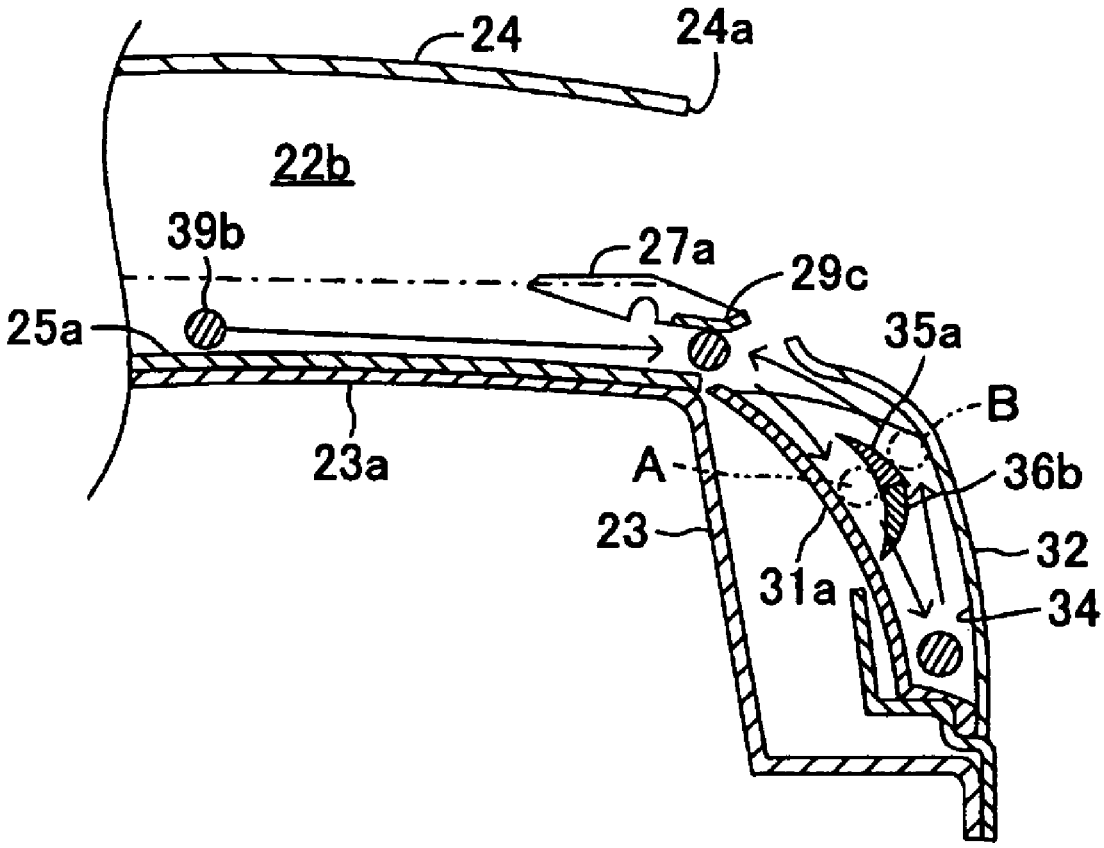
FIG. 9 is a cross-sectional view of a portion of a support unit of the seat assembly, illustrating a movement of a projection of the support unit.

As shown in FIG. 9, each projection 39*b*, 39*c* can be movable between an upper area of the bottom surface section 25*a* of the base member 25 and the inside of the guide groove 34. That is, each projection 39*b*, 39*c* moves along the bottom surface section 25*a* and the guide surface section 31*a* when each projection 39*b*, 39*c* passes toward a lower area of the guide groove 34 from the front end portion of the bottom surface section 25*a*. While moving, each projection 39*b*, 39*c* raises the raisable portion 29*c* and passes below a bottom side of the engagement arm section 27*a*, 27*b*. Each projection 39*b*, 39*c* also pushes the swingable piece 29 rearward and passes between the guide surface section 31*a* and the swingable piece 36*b*.

Figure 10:
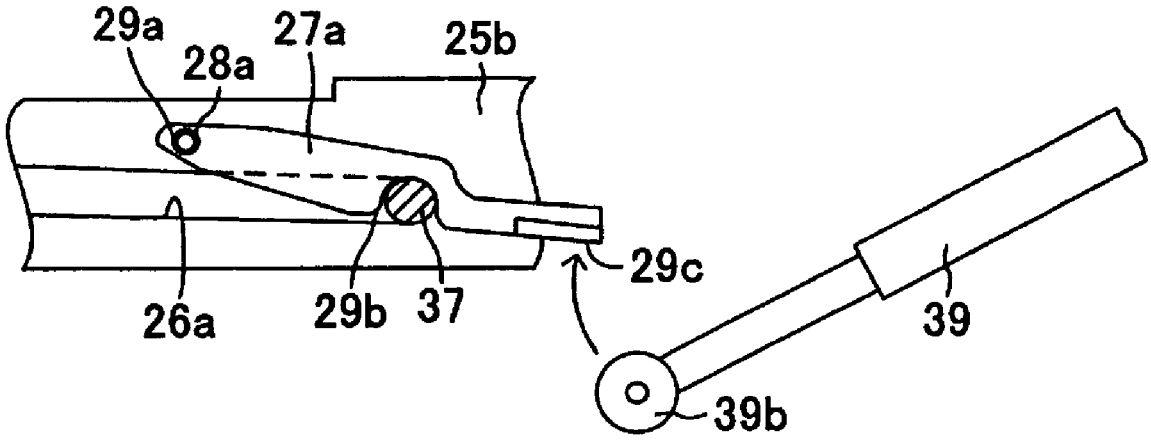
FIG. 10 is a schematic side elevational view of a condition under which the projection of the support unit raises a rear portion of the engagement arm section.

Each projection 39*b*, 39*c* passes between the swingable piece 36*b* and the guide opening forming section 32 when the projection 39*b*, 39*c* moves upward from the lower area of the guide groove 34. Further, as shown in FIG. 10, each projection 39*b*, 39*c* raises the raisable portion 29*c* and passes below a bottom side of the engagement arm section 27*a*, 27*b* when each projection 39*b*, 39*c* moves to the front end portion of the bottom surface section 25*a* from the lower area of the guide groove 34. Under the condition, the slide pin 37 disengages from the engagement recesses 29*b* of the engagement arm sections 27*a*, 27*b*.

The support unit 39 has a size that can pass, between the raisable portions 29*c* of the engagement arm sections 27*a*, 27*b*, between the guide piece units 35*a*, 35*b*, and through the guide opening 32*a*. Thus, the support unit 39 can be retracted onto the base member 25 within the storage space 22*b* together with the seat 21 by extending along the bottom surface of the seat 21. That is, the support unit 39 can be retracted between the bottom surface section 25*a* and the seat 21. Also, the support unit 39 can be positioned in the guide opening 32*a* under the condition that the support unit 39 can extend or contract in the vertical direction when the seat 21 is pulled out of the storage space 22*b*.

Because the seat structure 20 can be constructed as described above, the seat 21 can be retracted within the storage space 22*b* or can be pulled out of the storage space 22*b* in accordance with steerage conditions or preference of the rider. That is, when the rider needs to or desires to steer the small planing watercraft 10 while sitting on the seat 21, the rider can pull out the seat 21 from the inside of the hatch cover 22 and sets the support unit 39 in the supporting position, as shown in FIGS. 1 and 2.

Figure 11:
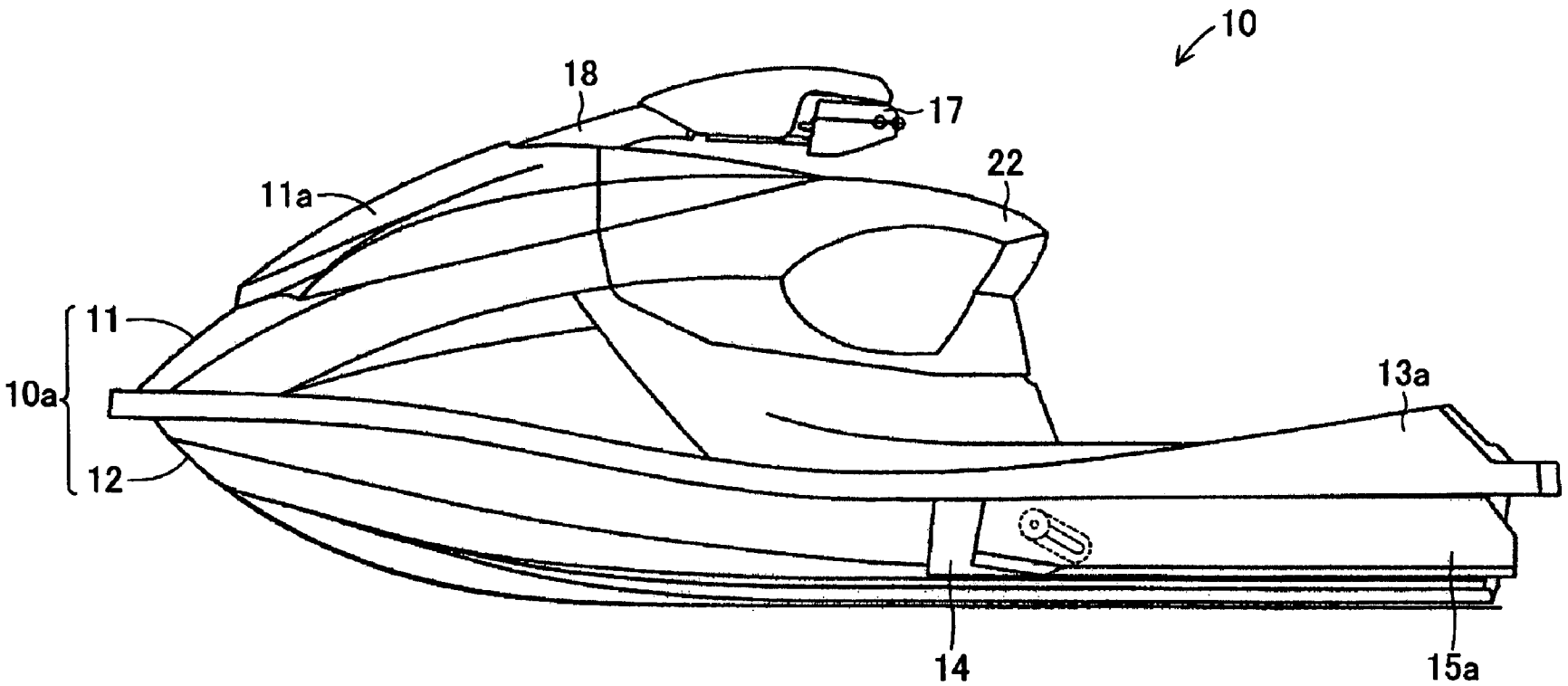
FIG. 11 is a side elevational view of the watercraft of FIG. 1 with the seat retracted into a storage compartment.
Figure 12:
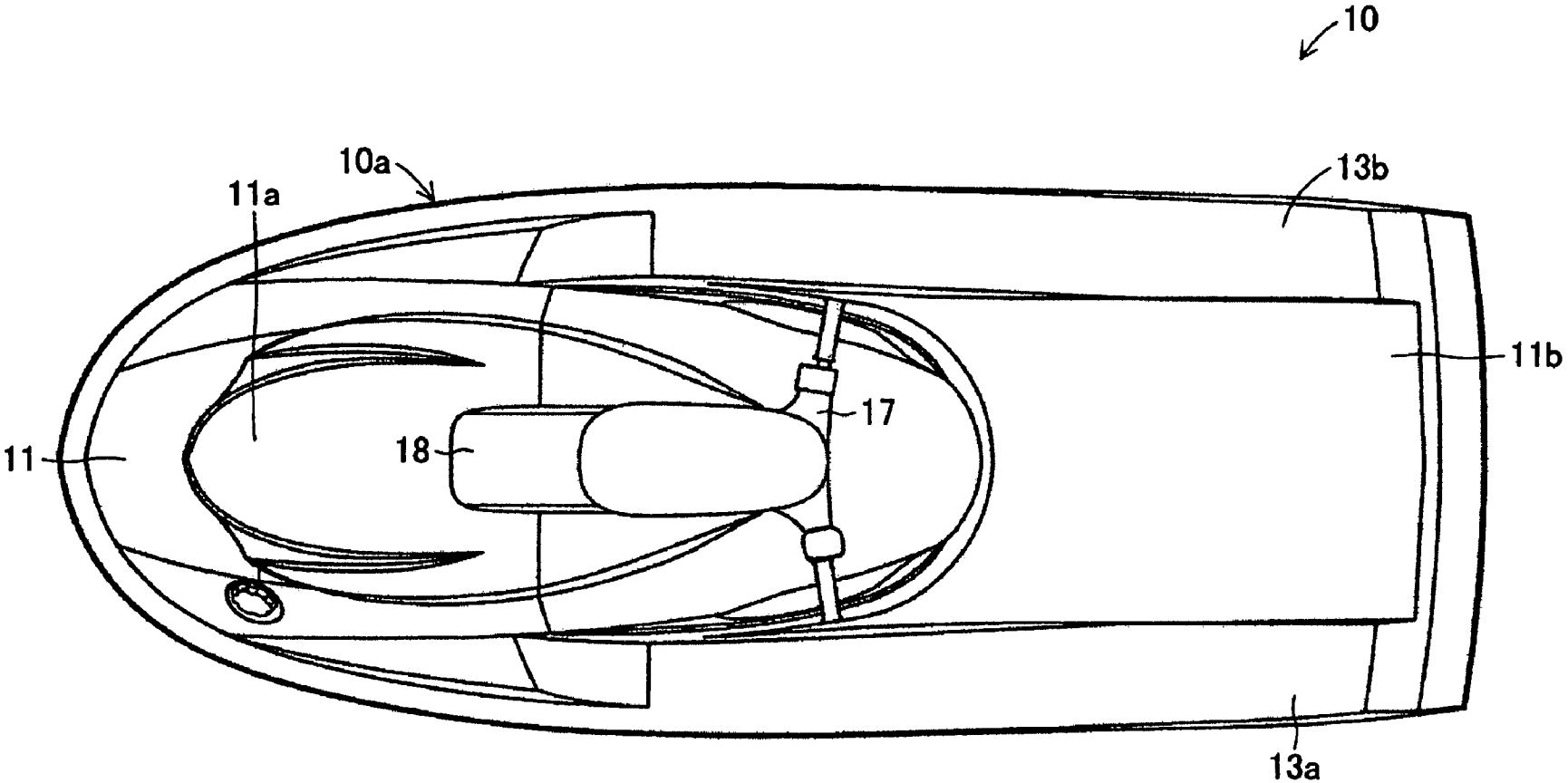
FIG. 12 is a top plan view of the small planing watercraft in the configuration shown in FIG. 11.

When the rider needs to or desires to steer the small planing watercraft 10 while standing on the floor section 11*b*, the rider can retract the seat 21 within the storage space 22*b* as shown in FIGS. 11 and 12. Also, the hatch cover 22 can be pivotable about an axis of a support shaft (hot shown) that can be positioned at a rear bottom of the hatch cover 22. Thus, the top portion of the front deck section 11*a* can be opened by rotating the front portion of the hatch cover 22 rearward about the axis of the support shaft, under the condition that the connecting pole 18 extends upward. Thereby, the user or rider can perform maintenance work such as inspection, repairs or the like on components located within the hull 10*a*.

As shown in FIGS. 1 and 2, an engine 41 can be located in a center bottom space within the hull 10*a*. An air duct 42 can be disposed in a forward space of the hull 10*a* for introducing ambient air into the hull 10*a*. The air duct 42 can extend vertically to a bottom area of the hull 10*a* from a top area of the hull 10*a*. The air duct 42 thus can guide ambient air from its top end through a water-resistant structure of the front deck section 11*a* and introduce the air into a bottom area of the hull 10*a* from its bottom end. A fuel tank 43 can be also disposed in the forward space of the hull 10*a* for accumulating fuel.

An intake box 44 can be disposed between the engine 41 and the fuel tank 43 within the hull 10*a*. The intake box 44 supplies the air introduced into the inside of the hull 10*a* through the air duct 42 to the engine 41. Also, the fuel can be supplied to the engine 41 from the fuel tank 43. Any type of fuel delivery system can be used. In some embodiments, the fuel delivery system includes a fuel injection device (not shown) that is configured to spray the fuel supplied from the fuel tank 43 into cylinders of the engine. While sprayed, the fuel is mixed with the air supplied from the intake box 44 and is sent to the engine 41 as an air/fuel mixture. An ignition device of the engine 41 ignites the mixture for combustion.

A crankshaft (not shown) can extend rearwardly from a rear portion of the engine 41. The crankshaft converts a reciprocal movement of pistons (not shown) caused by the combustion of the mixtures to a rotational movement.

The crankshaft can be connected to an impeller shaft (not shown). The impeller shaft can comprise a single shaft or a plurality of shafts connected together. The impeller shaft can be coupled with a jet propulsion device 45 mounted on the stern of the hull 10*a*.

An impeller (not shown) can be affixed to the impeller shaft within the jet propulsion device 45. The rotational power of the crankshaft made by the engine 41 thus can be transmitted to the impeller through the impeller shaft, thereby rotating the impeller and generating thrust for the watercraft 10.

The jet propulsion device 45 can have a water inlet 45*a* that opens at the bottom of the hull 10*a* and a discharge nozzle (not shown) that opens at the stern of the hull 10*a*. The jet propulsion device 45 can be configured to eject water through the discharge nozzle to generate propulsive power of the hull 10*a*.

The jet propulsion device 45 can be affixed to a bottom portion of the stern of the bull 10*a* such that a hull tunnel (not shown) isolates the device 45 from the body of the hull 10*a*. The impeller shaft penetrates the hull tunnel to extend to the jet propulsion device 45 from the engine 41.

A steering nozzle (not shown) can be attached to a rear portion of the discharge nozzle. Operational wires can be used to connect the steering nozzle with the steering handlebars 17 such that the steering nozzle is pivoted rightward or leftward in response to corresponding operations of the steering handlebars 17.

An exhaust device that includes exhaust conduits 46*a*, 46*b* and a water-lock 46*c* can be coupled with the engine 41. The exhaust conduit 46*a* transfers exhaust gases discharged from the engine 41 to the water-lock 46*c*.

The water-lock 46*c* can be in the configuration of a tank that has a large (wide) lower portion and a small (narrow) upper portion. However, this is merely one optional configuration for the water-lock 46*c*.

The exhaust conduit 46*a* can be connected to a lower side portion of the water-lock 46*c*, and the exhaust conduit 46*b* can be connected to a top surface of the water-lock 46*c*. The exhaust conduit 46*b* can be arranged to extend upwardly from the top surface of the water-lock 46*c* and to further extend rearwardly and downwardly. A downstream end of the exhaust conduit 46*b* can open at the hull tunnel that isolates the jet propulsion device 45 from the body of the hull 10*a* and communicates outside from a rear end portion of the hull 10*a*.

The small planing watercraft 10 can also have, other than the devices described above, electrical control device's such as a CPU, a ROM, a RAM, a timer and so forth, electric component boxes accommodating various electrical components or devices, and various devices, such as various sensors or switches, that are useful for operation of the small planing watercraft 10.

Operations for running the small planing watercraft 10 that is constructed as described above is further described below. For example, if a rider wishes to operate the small planing watercraft 10 while sitting on the seat 21, the rider can pull out the seat 21 from the inside of the hatch cover 22 and set the support unit 39 to support the seat 21.

Figure 13:
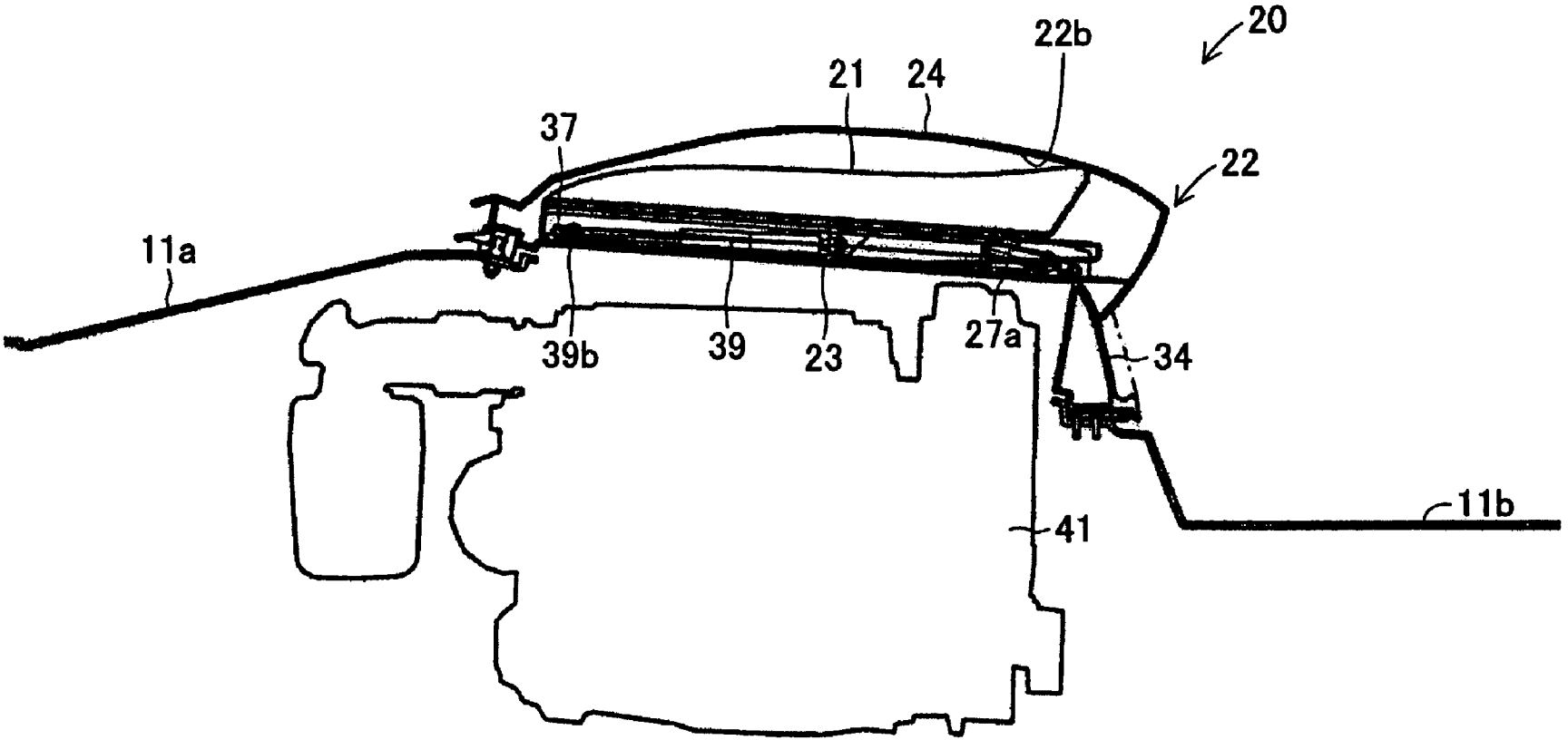
FIG. 13 is a schematic partial side elevational and cross-sectional view of the watercraft in the configuration shown in FIG. 11.
Figure 14:
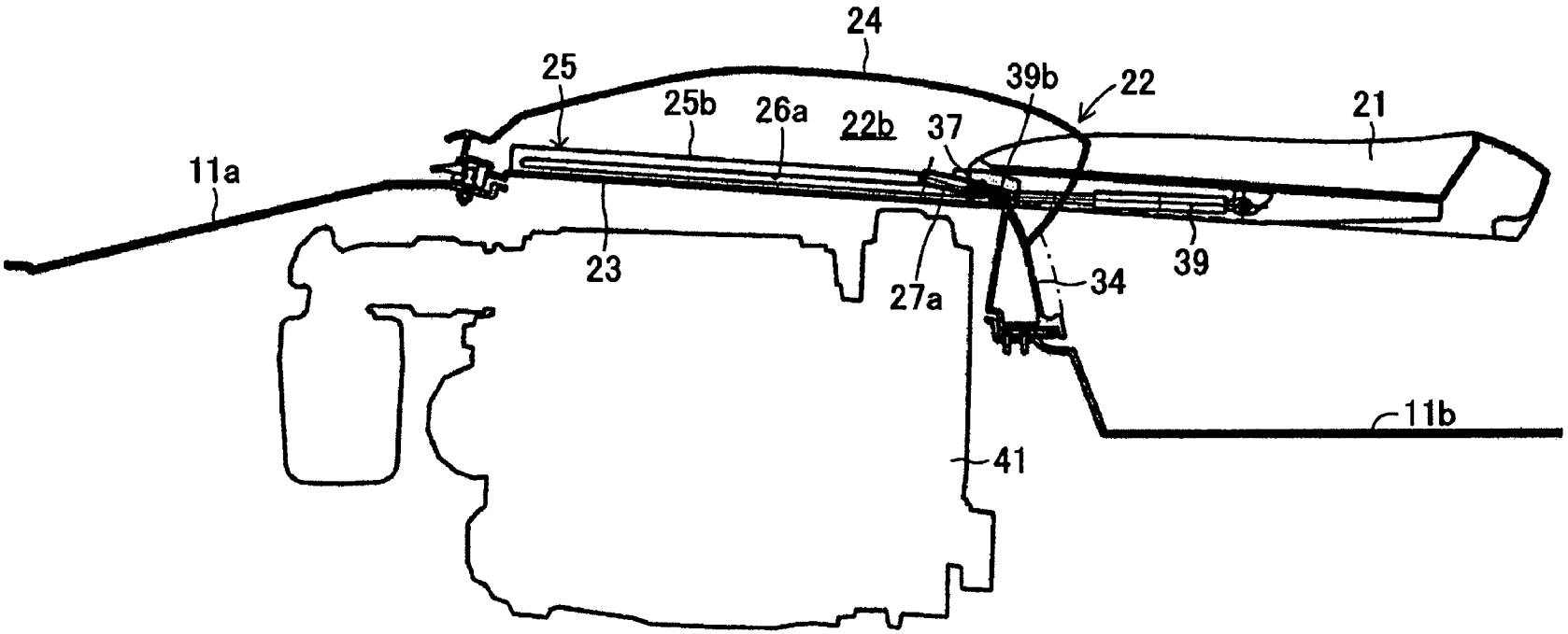
FIG. 14 is a schematic partial side elevational and cross-sectional view of the watercraft shown in FIG. 11, with the seat extended rearwardly.

This operation begins with the seat 21 being retracted inside of the hatch cover 22 as shown in FIG. 13. Then the seat 21 is pulled rearwardly from the hatch cover 22, as shown in FIG. 14. While the seat 21 is moved, the slide pin 37 engages with the recesses 29*b* of the respective arm sections 27*a*, 27*b*, while the projections 39*b*, 39*c* of the support unit 39 stay above the rear end portion of the bottom surface section 25*a*.

Figure 15:
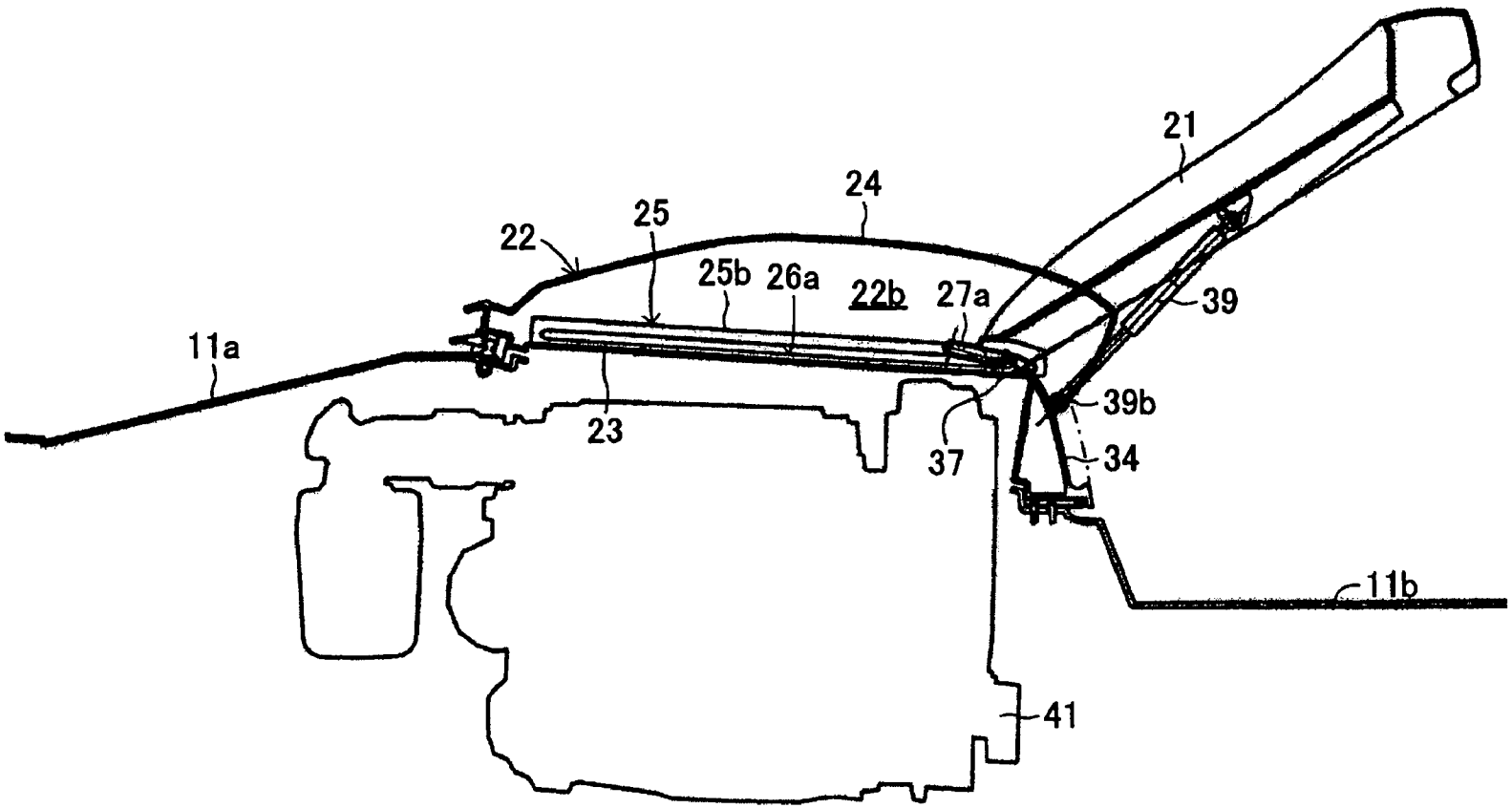
FIG. 15 is a schematic partial side elevational and cross-sectional view of the watercraft shown in FIG. 11 with a rear portion of the seat lifted upwardly.

Next, as shown in FIG. 15, the rider lifts the rear end portion of the seat 21 to set a slant angle of the seat 21 from the horizontal plane to a preset angle. The projections 39*b*, 39*c* can move to the guide groove 34 from the bottom surface section 25*a* when the slant angle of the seat 21 equals to the preset angle.

In this state, the projections 39*b*, 39*c* are placed at the positions indicated by the double dotted chain line circle A of FIG. 9. Thereby, the projections 39*b*, 39*c* of the support unit 39 can be pulled rearward and move to the guide surface section 31*a* from the bottom surface section 25*a*.

Then, the rider can release the rear end portion of the seat 21 to allow the seat 21 to move downwardly. The seat 21 thus changes to the condition shown in FIG. 16. On the way to this condition of the seat 21, the projections 39*b*, 39*c* descend along the guide surface section 31*a* and engage with the bottom end portion of the guide groove 34 (i.e., the bottom end portion of the wall section 31*b*). The center portion of the seat 21 thus can be supported by the support unit 39.

Figure 16:
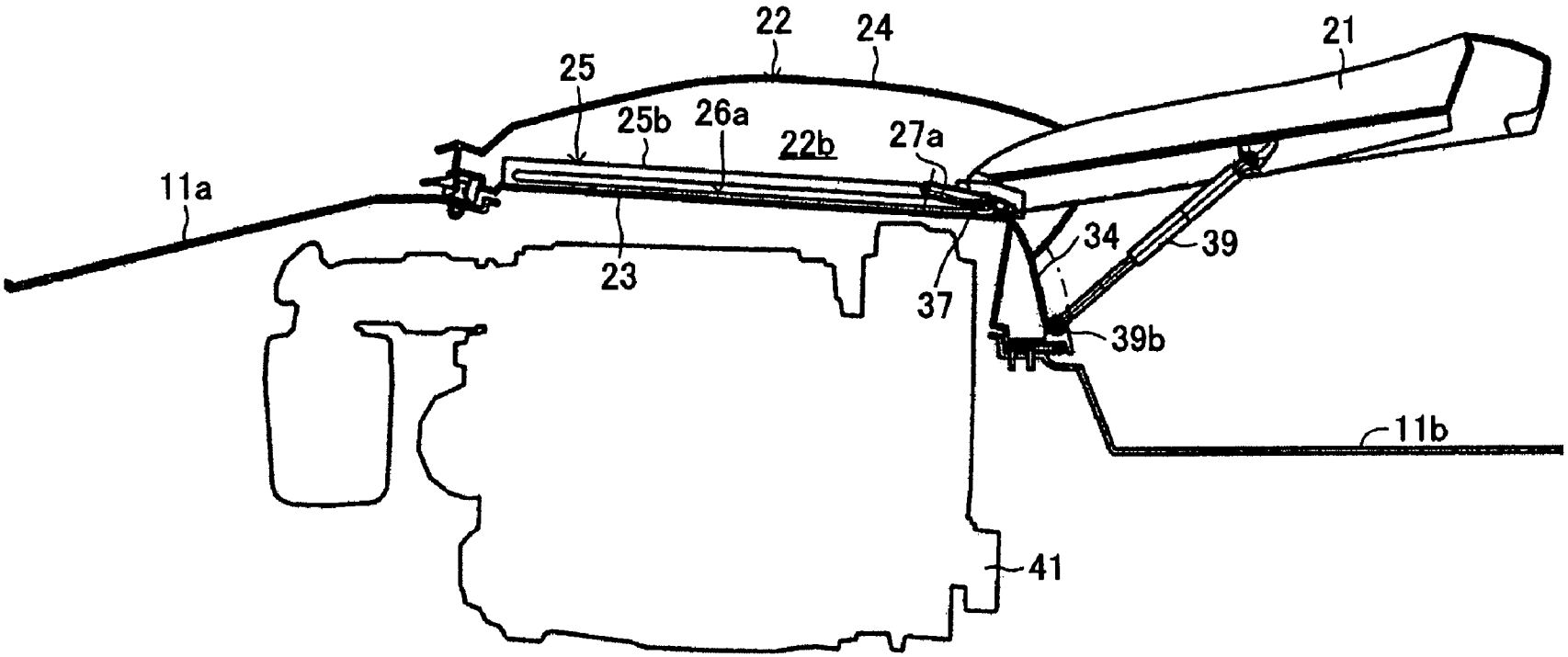
FIG. 16 is a schematic partial side elevational and cross-sectional view of the watercraft shown in FIG. 1 with the seat is supported by a support unit.

In the orientation of shown in FIG. 16, the rider sitting on the seat 21 can hold the handling grips 17*a*. The rider can also activate a start switch (not shown) to set the small planing watercraft 10 to be ready for running. With the rider's operations of the steering handlebars 17 and throttle control members provided on one of the handling grips 17*a*, the small planing watercraft 10 can run in a desired direction and at a desired, speed corresponding to the operations.

Under the running condition, the rider can operate the lifting mechanism 16 to move the supplemental hull components 15*a*, 15*b* upward or downward. Thereby, the rider can achieve additional adjustments of the handling characteristics of the hull 10*a* as he or she desires. Additionally, through other operations, the connecting pole 18 can be positioned at the front end of its movable range by engaging the support shaft 18*a* and the support shaft engagement with recess 53*a* with each other.

Under the circumstances described above, if the rider desires to run the small planing watercraft 10 while standing on the floor section 11*b* without the seat being in the way, the rider can first lift the rear portion of the seat 21 to change the condition of the seat 21 shown in FIG. 16 to a condition similar to the condition shown in FIG. 15. Thereby, the seat 21 pivots about the axis of the slide pin 37, and the projections 39*b*, 39*c* of the support unit 39 passes between the swingable pieces 36*b* of the respective guide piece units 35*a*, 35*b* and the guide opening forming section 32 to ascend within the guide groove 34.

Afterwards, the slant angle of the seat 21 becomes a preset angle for its retraction. This preset angle can be slightly larger than the preset angle for the extension. Also, the projections 39*b*, 39*c* can move to the bottom surface section 25*a* from the guide groove 34 without descending when the seat can be positioned at this preset angle. The double dotted chain line circle B of FIG. 9 indicates positions of the projections 39*b*, 39*c* in this state. The rider releases the rear portion of the seat 21 to allow the seat 21 to be in the position of FIG. 14, when the slant angle of the seat 21 becomes the preset angle for the retraction and the projections 39*b*, 39*c* ascend to reach their preset positions.

On this occasion, the projections 39*b*, 39*c* are prevented from descending by the fixed pieces 36*a* of the guide piece units 35*a*, 35*b* and move to the bottom surface section 25*a*. The projections 39*b*, 39*c* then raise the raisable portion 29*c* of the respective engagement with arm sections 27*a*, 27*b* and disengage the slide pin 37 from the engagement with recess 29*b* of the respective engagement with arm sections 27*a*, 27*b*, as shown in FIG. 10. In this state, the support unit 39 extends along the bottom surface of the seat 21. The rider, next, pushes the seat 21 forward to set it to the condition shown in FIG. 13. Thereby, the seat 21 and the support unit 39 are housed within the storage space 22*b*.

Also, the rider can lift up the steering handlebars 17 to disengage the support shaft 18*a* from the support shaft engagement with recess 53*a* and pulls the steering handlebars 17 rearward. The steering handlebars 17 thus moves to the upper rear portion along a locus indicated by the one dotted chain line "a" of FIG. 3. That is, under the condition, the support shaft 18*a* can be positioned at the rear end portion 53*b* of the support shaft slide groove 53, and the guide shaft 18*b* engages with the guide shaft engagement with recess 55*b*. Thus, when the rider stands on the floor section 11*b* and takes hold of the steering handlebars 17 while pushing it downward, the connecting pole 18 can be maintained in this state. The rider can easily control the hull 10*a* while standing, accordingly.

Further, if the rider desires to actively steer the small planing watercraft 10 under the standing condition on the floor section 11*b*, such as, for example, to turn the hull 10*a* while moving the steering handlebars 17 up and down, the rider can pull the steering handle 17 rearwardly while lifting it up. Thereby, the guide shaft 18*b* disengages from the guide shaft engagement with recess 55*b* and becomes ready to move along the arcuate groove section 55. The steering handle 17 thus can move along the locus indicated by the one dotted chain line "b" of FIG. 3.

Under the condition that the guide shaft 18*b* can be positioned in the arcuate groove 55, the lever 56 and the spring 57 together urge the guide shaft 18*b* upward. Thus, all the rider needs to do is to softly move the steering handlebars 17 up and down to move the steering handle 17 along the locus indicated by the one dotted chain line "b" of FIG. 3. The rider, therefore, can perform turns while moving the steering handlebars 17 in the standing position on the floor section 11*b*.

As thus described, in connection with the small planing watercraft 10 of this embodiment, if the rider desires to steer while sitting on the seat 21, the rider can extend the seat 21 rearward from the hatch cover 22. If the rider desires to steer it while standing, the rider can retract the seat 21 within the storage space 22*b*. Thus, the rider can choose to steer the watercraft 10 in the sitting position or the standing position.

To extend the seat 21, the rider can simply pull the rear end portion of the seat 21 rearwardly with only one hand, and then can and release the seat 21 after lifting the seat 21 to the preset angle. Also, to retract the seat, it is only required to simply lift the rear end portion of the seat 21 upwardly, with only one or both hands if desired, and to push the seat 21 forward while keeping it horizontal. Thus, the extension and the retraction of the seat 21 can be quite easily performed.

The seat structure also does not detract from the external appearance of the watercraft, because the rear end surface of the seat 21 can be flush with the hatch cover 22 when the seat 21 is retracted within the storage space 22*b*. As such, the rear end surface of the hatch cover 22 has no irregularities. Also, the seat 21 can be maintained in a stable condition when the seat 21 is pulled out rearwardly from the hatch cover 22, because the front end portion of the seat 21 can be supported by the rear end portion of the base member 25 and the generally center portion of the seat 21 can be supported by the support unit 39. The rider thus can steer the craft in a stable, seated position.

The height of the rear portion of the seat 21 can be adjusted to accommodate the physique of the rider. For example, the length of the support unit 39 can be adjustable. Also, the storage space 22*b* can be made small because the support unit 39 can be folded when the seat 21 is retracted within the storage space 22*b*. Further, the ride comfort of the small planing watercraft 10 can be improved, because shocks can be absorbed by the dampers included with the support unit 39. The rider thus can enjoy comfortable planing. In addition, the seat 21 or the hull 10*a* is less likely to be damaged or harmed, because the impact load to the seat 21 or the hull 10*a* affected by the rider can be reduced by the shock absorbing function of the support unit 39.

The present seat structure is not limited to the embodiment described above. For example, in the above embodiment, the slide slots 26*a*, 26*b* work as the slide recess. The slide recess, however, can have any configuration for allowing the seat 21 to move in the fore aft direction, and thus can be formed with a groove or grooves. Also, a damper formed with a spring or other shock absorbing members can replace the gas damper described above. In addition, other structures or materials of the respective members or components that form the seat structure 20 or the small planing watercraft 10 are suitably changeable within the scope of the inventions disclosed herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A seat structure for a small planing watercraft which comprises a deck forming an upper hull, a forward portion of the deck having a front deck section, a rear portion of the deck having a generally horizontally extending floor section, steering handlebars generally extending above a center portion of the deck in a fore to aft direction of the hull, and a seat structure for a rider disposed in the rear of the front deck section, the seat structure comprising a rear portion of the front deck section, the rear portion having an engine hatch, and a hatch cover disposed for selectively closing and opening the engine hatch, the rear portion defining a storage space above the engine hatch, and a seat being configured to retract into the storage space.

2. The seat structure according to claim 1, wherein a rear end of the hatch cover has an opening, the seat being configured to enter the storage space through the opening, and a rear end of the seat forms a portion of the hatch cover when the seat is retracted within the storage space.

3. The seat structure according to claim 2 additionally comprising a rail section extending in the fore to aft direction within the storage space, the seat having a movable section that is movable along the rail section so that the seat is movable between a retracted position where the seat is retracted within the storage space and an extending position where the seat extends rearward from the front deck section.

4. The seat structure according to claim 3 further comprising an engagement mechanism configured to engage a front end of the seat and a rear end of the rail section with each other, and a support member configured to support a portion of the seat that is situated rearward of the front end of the seat, the front end of the seat engaging with the rear end of the rail section and the support member supporting the portion of the seat when the front end of the seat is positioned at the rear end of the rail section.

5. The seat structure according to claim 4, wherein the engagement mechanism is configured such that the front end of the seat is coupled with the rear end of the rail section for pivotal movement in a generally vertical direction.

6. The seat structure according to claim 4, wherein one end of the support member is pivotally connected to a bottom surface of the seat for pivotal movement in a generally vertical direction, additionally comprising a guide groove extending from a rear end portion of the rail section and a lower rear end of the hatch cover, another end of the support member being movable along the guide groove, the support member extending along the bottom surface of the seat and extending into the storage space together with the seat when the seat is in its retracted position, the support member being configured to engage a bottom end of the guide groove and to support the seat when the seat is in its extended position.

7. The seat structure according to claim 4, wherein the support member comprises a damper.

8. The seat structure according to claim 4, wherein the support member is configured to have an adjustable length.

9. The seat structure according to claim 4, wherein the rail section has a pair of slide recesses spaced apart from one another and extending parallel to each other in a fore to aft direction, the engagement mechanism comprising a slide pin positioned at a front end of the seat with opposing ends capable of movably engaging with the respective slide recesses, and an engagement arm section, a forward end of the engagement arm section being coupled with a portion of the rear end of the rail section at a position higher than a path of the slide pin for pivotal movement in the vertical direction, a rear end of the engagement arm section being positioned in the path through which the slide pin passes, and a lower portion of the rear end of the engagement arm section having an engagement recess capable of engaging the slide pin.

10. The seat structure according to claim 9, wherein an end of the support member has a projection extending transversely, the projection of the support member passing below a bottom side of the engagement arm section to move to a guide groove so that the support member supports the seat when the seat is pulled out of the storage space, the projection being configured to raise the rear end of the engagement arm section to disengage the slide pin from the engagement recess of the engagement arm section when the seat is lifted up to move the projection of the support member to the rail section from the guide groove under the condition that the slide pin engages with the engagement recess of the engagement arm section.

11. The seat structure according to claim 10, wherein the hatch cover includes a guide piece disposed next to a portion of the guide groove that is positioned adjacent to the rail section, the guide piece being spaced apart from the guide groove, the projection of the support member being moveable between the guide groove and the guide piece when the seat is pulled out of the storage space, the projection of the support member being configured to surmount an outer side surface of the guide piece to move to the rail section when the seat is lifted up to move the projection to the rail section from the guide groove.

12. The seat structure according to claim 1, wherein the watercraft includes a steering pole with a front end, the front end having an engaging portion, a forward portion of the front deck section has a receiving portion with which the engaging portion is engageable, the engaging portion being movable in the fore to aft direction under an engagement condition with the receiving portion.

13. The seat structure according to claim 12 additionally comprising a movement preventing mechanism configured to prevent the engaging portion from moving in the fore to aft direction beyond a predetermined position along the watercraft in the fore to aft direction.

14. The seat structure according to claim 12, wherein the steering pole is configured to be pivotable in the vertical direction about the engaging portion at least when the engaging portion is placed at the rear-most end in a movable range of the fore to aft direction of the watercraft.

* * * * *

UNITED STATES PATENT AND TRADEMARK OFFICE

CERTIFICATE OF CORRECTION

PATENT NO. : 7,343,869 B2
APPLICATION NO. : 11/207332
DATED : March 18, 2008
INVENTOR(S) : Yoshiki Futaki It is certified that error appears in the above-identified patent and that said Letters Patent is hereby corrected as shown below:

On column 1, line 33, After "by the" delete ",".

On column 2, line 14, After "his" delete "-or" and insert -- or --, therefor.

On column 3, line 4, Delete "planning" and insert -- planing --, therefor.

On column 3, line 34, Delete "planning" and insert -- planing --, therefor.

On column 5, line 13, Delete "seal" and insert -- seat --, therefor.

On column 5, line 15, Delete "seal" and insert -- seat --, therefor.

On column 5, line 30, Delete "coyer" and insert -- cover --, therefor.

On column 8, line 43, Delete "hot" and insert -- not --, therefor.

On column 9, line 31, Delete "bull" and insert -- hull --, therefor.

On column 9, line 60, Delete "device's" and insert -- devices --, therefor.

Signed and Sealed this

Twenty-fourth Day of February, 2009

John Doll

JOHN DOLL
*Acting Director of the United States Patent and Trademark Office*